US011235337B2

(12) United States Patent
Winter et al.

(10) Patent No.: US 11,235,337 B2
(45) Date of Patent: Feb. 1, 2022

(54) METHOD AND DEVICE FOR DISCHARGING HARD TO GRIND PARTICLES FROM A SPIRAL JET MILL

(71) Applicant: NETZSCH Trockenmahltechnik GmbH, Selb (DE)

(72) Inventors: Frank Winter, Mühlheim (DE); Hermann Sickel, Gambach/Muenzenberg (DE)

(73) Assignee: NEIZSCH Trockenmahltechnik GmbH, Hanau (DE)

( * ) Notice: Subject to any disclaimer, the term of this patent is extended or adjusted under 35 U.S.C. 154(b) by 263 days.

(21) Appl. No.: 16/544,163

(22) Filed: Aug. 19, 2019

(65) Prior Publication Data

US 2020/0061631 A1 Feb. 27, 2020

(30) Foreign Application Priority Data

Aug. 23, 2018 (DE) ..... 102018120596.1

(51) Int. Cl.
*B02C 19/06* (2006.01)
*B02C 23/16* (2006.01)

(52) U.S. Cl.
CPC ..... *B02C 19/061* (2013.01); *B02C 23/16* (2013.01)

(58) Field of Classification Search
CPC ..... B02C 19/06; B02C 19/061; B02C 19/16; B02C 25/00
See application file for complete search history.

(56) References Cited

U.S. PATENT DOCUMENTS 3,425,638 A * 2/1969 Becker ..... B02C 19/061 241/39
3,602,439 A * 8/1971 Nakayama ..... B02C 19/061 241/39
3,726,483 A * 4/1973 Kometani ..... C08J 3/12 241/5
3,726,484 A * 4/1973 Schurr ..... B02C 19/061 241/5
4,502,641 A * 3/1985 Coombe ..... B02C 19/061 241/39
8,177,149 B2 * 5/2012 Nied ..... B02C 19/065 241/5
2008/0048058 A1 * 2/2008 Ito ..... B02C 19/061 241/5

(Continued)

FOREIGN PATENT DOCUMENTS

DE 102006001937 A1 9/2009
WO 9601694 A1 1/1996

*Primary Examiner* — Faye Francis
(74) *Attorney, Agent, or Firm* — Whitmyer IP Group LLC

(57) ABSTRACT

A grinding, separating, and discharging of hard to grind parts of a material mixture of components with different grindability from a spiral jet mill, wherein the hard to grind parts are discharged from the process chamber via at least one additional discharge nozzle. A spiral jet mill for comminuting and classifying grinding material, including at least one process chamber, wherein this at least one process chamber is enclosed by a housing, at least one grinding material feeding, which leads into the at least one process chamber, at least two grinding nozzles, a fine material outlet, which is radially enclosed by a separator wheel, wherein at least one discharge nozzle is assigned to the process chamber.

13 Claims, 1 Drawing Sheet

(56) References Cited

U.S. PATENT DOCUMENTS

| | | | | |
|---|---|---|---|---|
| 2012/0263954 | A1* | 10/2012 | Van Remortel | C09C 1/402<br>428/402 |
| 2013/0221141 | A1* | 8/2013 | Zhang | B02C 19/065<br>241/39 |
| 2014/0084088 | A1* | 3/2014 | Coates | B02C 23/08<br>241/5 |

* cited by examiner

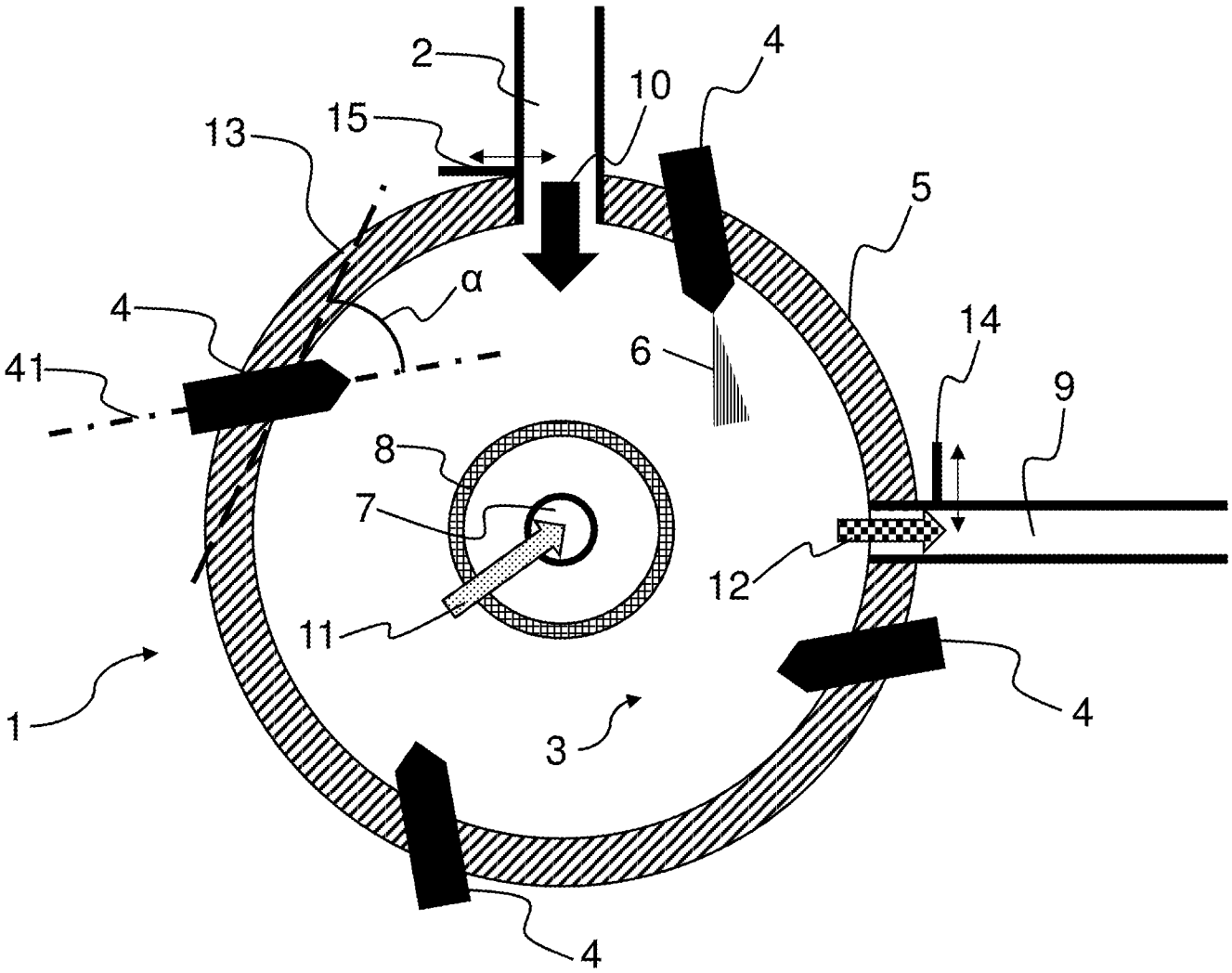
1
41
4
13
15
2
α
10
4
5
6
14
9
8
7
11
12
3
4
4

METHOD AND DEVICE FOR DISCHARGING HARD TO GRIND PARTICLES FROM A SPIRAL JET MILL

TECHNICAL FIELD

The present invention relates to a method and to a device for discharging hard to grind particles from a spiral jet mill according to the features of the invention.

BACKGROUND

Spiral jet mills are known from the prior art, such as from DE 44 31 534 A1. These spiral jet mills are used to comminute different materials. The particles to be comminuted are accelerated by means of gas jets, in order to be comminuted by means of mutual impact. Gravitational forces, which additionally contribute to the comminution process, further appear at those locations, at which the particles are accelerated by means of the gas jets.

In the case of feedstock of different components, it may happen that only some of them can be ground by means of the spiral jet mill. The sufficiently comminuted particles leave the grinding chamber, in which the sufficiently comminuted particles, also referred to as fine material, pass through a classifier, for example a separator wheel, and subsequently leave the spiral jet mill via a fine material outlet. Components, which have other properties, such as, for example, ductile behavior or a higher hardness, can remain in the grinding chamber. These hard to grind parts, or also coarse portions, accumulate in the grinding chamber as the grinding process continues and thus decrease the volume of the grinding chamber, which should actually be available for the grinding, the throughput capacity of the spiral jet mill thus drops significantly.

Of spiral jet mills from the prior art, it is known that these hard to grind parts are discharged from the mill by means of a reduction of the separator speed. A complete contamination of the system with coarse particles is a disadvantage of the reduction of the separator speed. Following this, the fluidized bed has to be refilled again, which has the result that shifts occur in the grain distribution until the optimal fill level is reached, and that low throughput capacities are attained as well. The system has to further be flushed, so that the coarse particles are removed from the system. This approach is highly inefficient and takes a lot of time.

SUMMARY

The object of the present invention is to optimize the grinding process to the effect that residues, which remain inside the grinding chamber during a grinding process, can be removed more quickly and more efficiently therefrom than is the case in the prior art.

The above objects are solved by means of the method and the device according to the claims. Further designs according to the invention can be gathered from the respective subclaims.

The invention relates to a method for grinding, separating, and discharging hard to grind parts of a material mixture of components with different grindability from a process chamber of a spiral jet mill. The different properties of the components included in the material mixture has the result that the sufficiently comminuted particles, also described as fine material, leave the process chamber via the fine material outlet after a classification. The classification takes place, for example, by means of a separator wheel. The hard to grind parts, also described as coarse portions, are not able to get past the classifier and are thus held back in the process chamber. To avoid an accumulation of coarse portions in the process chamber, the coarse portions are discharged via at least one discharge nozzle by means of a fluid.

The fluid, which discharges the coarse portions from the process chamber, is provided by the grinding nozzles, which protrude into the process chamber. During the grinding process, these nozzles provide the gas jets, by means of which the particles of the feedstock are comminuted. Due to the negative pressure or positive pressure, which prevails in the process chamber, the coarse portions are discharged from the process chamber via the at least one discharge nozzle by means of the grinding gas.

To further optimize the method, the discharge nozzle is closed towards the process chamber during the grinding process and is manually or automatically opened only during a coarse portion discharge phase.

The manual or automatic interruption of the grinding material feeding is a further advantage of the method according to the invention. In this way, it is prevented that material, which is not ground, is supplied to the grinding chamber via the grinding material inlet during the emptying of the grinding chamber or during the discharge of the hard to grind parts from the grinding chamber, respectively. The supply of grinding material into the process chamber via the grinding material feeding takes place by means of a metering unit, for example via a rotary feeder or a metering pump.

The discharge nozzle as well as the grinding material feeding can be closed with respect to the process chamber by means of closure elements. The closure elements can be embodied, for example, as flap, gate, or rotary feeder.

To be able to better regulate the interruption of the grinding material feeding, at least one operating parameter of the method is detected via the at least one sensor. Important operating parameters are, for example, the fill level of the mill, quantity and speed of the grinding material feeding, and quantity, pressure and speed of the used grinding fluid, speed of the separator wheel, and power consumption of the motor, which drives the separator wheel, as well as the grinding material throughput.

The different parameters interact with one another, in particular the fill level of the mill and the grinding material feeding. The fill level of the mill is controlled via the power consumption of the separator wheel. If ground grinding material leaves the process chamber via the separator wheel and the fine material outlet, less grinding material is located in the process chamber, and fewer collisions of particles of the grinding material with the separator wheel occur. As a result of this, the power required to maintain a constant speed of the separator wheel drops, the power consumption of the motor, which drives the separator wheel, drops. If the power consumption leaves a defined minimum value, for example falls below 60% of the maximum power of the motor, which drives the separator wheel, grinding material is fed into the process chamber via the grinding material feeding, until the power consumption of the motor, which drives the separator wheel, has reached a defined maximum value again, for example 65% of the maximum power of the motor, which drives the separator wheel, due to the number of collisions with grinding material, which now rises again. As a function of the fed grinding material, the limits for the power consumptions of the motor, which drives the separator wheel, can vary. For example, values of between 30% and 80%, in particular between 40% and 60%, are possible for the minimum value. The maximum value for the power consumption of the motor, which drives the separator wheel, can be between 50% and 100%, in particular between 60% and 80%.

In the case of grinding material, which does not have any parts, which are hard to grind or which cannot be ground, the process for the grinding material feeding described in the above paragraph is expressed as constant interval. This means that the intervals between stop of the grinding material feeding and start of the grinding material feeding, as well as the duration of the grinding material feeding behave approximately periodically. This is not so in the case of grinding material with parts, which are hard to grind or which cannot be ground.

The accumulation of the parts of the grinding material, which are hard to grind or which cannot be ground, has the result that fewer particles than usual leave the process chamber. This is why the power consumption of the motor, which drives, the separator wheel, also does not drop very quickly below the defined minimum value, which also correlates with a delay of the grinding material feeding. The parts of the grinding material, which are hard to grind or which cannot be ground, which remain in the process chamber, continue to use the separator wheel, but without passing it, the power consumption of the motor, which drives the separator wheel, thus does not drop as in the case of normal grinding material without parts, which are hard to grind or which cannot be ground, and the intervals between stop of the grinding material feeding and start of the grinding material feeding increase. The duration of the grinding material feeding, in contrast, decreases, because, after falling below the defined minimum value for the power consumption of the motor, which drives the separator wheel, the corresponding maximum value is reached more quickly, because a higher number of particles has remained in the process chamber.

As the grinding duration rises, a significant decrease in the throughput can be detected due to the described behavior of grinding material with parts, which are hard to grind or which cannot be ground. This decrease of the throughput can preferably be used as a control value for the discharge of the parts, which are hard to grind or which cannot be ground, from the mill.

If at least one defined value range of the at least one monitored operating parameter is left, for example of the throughput, the grinding material feeding is stopped automatically. The opening and closing of the discharge nozzle can be controlled analogously to the grinding material feeding, thus also as a function of the operating parameters. The interruption or the start of the grinding material feeding and the opening or closing of the discharge nozzle can also be adapted to one another. It is possible, for example, to only control the grinding material feeding via at least one operating parameter. If at least one operating parameter, e.g. the throughput capacity, or the interval duration of the material supply, leaves the value range defined for it, the interruption of the grinding material feeding is activated. As a function of this, the opening of the discharge nozzle can be activated simultaneously or offset in time. The same is also conceivable when only the discharge nozzle is controlled via at least one operating parameter, and the grinding material feeding reacts as a function thereof. It is thus possible to create conditions, which are stable for the grinding process and which are adapted to the corresponding grinding material, in an automated manner. The corresponding value ranges for the operating parameters are to be selected depending on the material and grinding fluid.

Depending on the grinding material, the opening time of the discharge nozzle, as well as the interruption of the grinding material feeding, is set individually. The opening time of the discharge nozzle is preferably 1-10 seconds. The interruption of the grinding material feeding is preferably 1-10 seconds.

In an advantageous version of the method, the opening of the discharge nozzle and the interruption of the grinding material feeding, as well as the closing of the discharge nozzle and the start of the grinding material feeding, is carried out so as to be adapted to one another. To avoid losses of the grinding material, it is advantageous when the grinding material feeding is interrupted prior to the opening of the discharge nozzle. Feedstock, which is not yet ground, can thus be ground, and the particles, which are still located in the process chamber and which are ground to the target size, can be discharged in this way.

BRIEF DESCRIPTION OF THE DRAWINGS

FIG. 1 is a sectional view of a spiral jet mill.

DETAILED DESCRIPTION

An exemplary sequence of the process could thus be described as follows:

1. At least one operating parameter leaves a defined value range due to accumulation of portions of the grinding material, which are hard to grind or which cannot be ground, in the process chamber.
2. Interruption of the grinding material feeding.
3. Grinding and discharging of the grinding material, which is still located in the process chamber.
4. Opening the discharge nozzle and discharging the portions of the grinding material, which are hard to grind or which cannot be ground, from the process chamber.
5. Closing the discharge nozzle.
6. Starting the grinding material feeding and continuing the grinding process.

Some of the above-described method steps preferably have a defined duration. For example, the grinding and the discharge of the portion of grindable portions of the grinding material, which are still located in the process chamber, are between one second and five minutes, in particular between 1 and 60 seconds. The opening duration of the discharge nozzle is between one second and one minute, in particular between 1 and 10 seconds. As soon as the discharge nozzle is closed, the renewed grinding material feeding can be started. The time between these two method steps can be between 0.5 and 60 seconds, in particular between 0.5 and 5 seconds.

The method according to the invention is carried out by a spiral jet mill for impacting partially comminutable and classifiable material. Such spiral jet mills have a process chamber, which is surrounded by a housing. At least two grinding nozzles protrude into the process chamber, the grinding fluid is guided into the process chamber through these grinding nozzles during the grinding process.

In the case of spiral jet mills, the process chamber is embodied to be rotationally symmetrically flat and round, comprising a radially extending housing wall, which is defined on the top and on the bottom by a circular area in each case, wherein the height of the cylinder is smaller than the diameter. The grinding nozzles are arranged tangentially on the housing wall. The grinding nozzles are further arranged on one plane with the separator wheel, which is located in the center of the process chamber. The separator wheel is also embodied to be rotationally symmetrically flat and round, comprising radially extending lamellae, which are defined on the top and on the bottom by a plate, which is embodied as circular area in each case, wherein the height of the cylinder body is also smaller than the diameter here.

Depending on the grinding material and grinding fluid, the set pressure, at which the grinding fluid is guided into the process chamber through the grinding nozzles, varies between 0.1 and 40 bar(g). Typical grinding fluids are air, nitrogen, steam and noble gases, such as, e.g., argon and helium.

The grinding material introduced via a grinding material inlet, which communicates with the process chamber, is detected by the grinding fluid jets, is accelerated, and is comminuted by means of particle-to-particle impacts. This is thus an autonomous grinding of the grinding material. The used particles are transported by the grinding fluid to the separator wheel, which is driven via a, for example frequency-regulated, motor. The desired target fineness of the fine material is preset via the speed of the separator wheel. After passing through the separator wheel, the fine material is discharged from the machine via the fine material outlet. Particles, which are too coarse or which have not been sufficiently ground yet, respectively, are rejected by the separator wheel and reach back into the product-loaded grinding material jets in this way for the renewed use. A circular movement of the grinding material is created in the process chamber in this way.

To discharge the portions of the parts of the grinding material, which are hard to grind or which cannot be ground, which accumulate in the process chamber, from the process chamber, a discharge nozzle is provided, which communicates with the process chamber. This discharge nozzle can be closed manually or in an automated manner with respect to the process chamber and is closed during the grinding process.

The machine according to the invention for impacting partially comminutable and classifiable material has measuring instruments, which detect the operating parameters of the grinding process. Relevant operating parameters are, for example, the throughput of grinding material per time unit, quantity, and speed of the grinding material feeding, and quantity, pressure, and speed of the used grinding fluid, speed of the separator wheel, and power consumption of the motor, which drives the separator wheel. The machine according to the invention further comprises a device, by means of which the metering of the grinding material into the process chamber can be detected and controlled.

Alternatively or additionally to the described features, the method can comprise one or a plurality of features and/or properties of the above-described device. Alternatively or additionally, the device can also have individual or a plurality of features and/or properties of the described method.

It is important to expressly mention at this point that all aspects and embodiment alternatives, which were described in connection with the starting mixture according to the invention and the system for producing the starting mixture, likewise relate to or can be partial aspects of the method according to the invention. When reference is thus made to certain aspects and/or relationships and/or effects at a point in the description or also in the case of the claim definitions relating to the starting mixture according to the invention and/or relating to the system, this likewise applies for the method according to the invention. The same applies, conversely, so that all aspects and embodiment alternatives, which were described in connection with the method according to the invention, likewise also relate to or can be partial aspects of the starting mixture according to the invention and of the system. When reference is thus made to certain aspects and/or relationships and/or effects at a point in the description or also in the case of the claim definitions relating to the method according to the invention, this likewise applies for the starting material according to the invention and for the system.

Exemplary embodiments are to describe the invention and its advantages below by means of the enclosed figures. The size ratios of the individual elements relative to one another in the figures do not always correspond to the actual size ratios, because some forms are illustrated in a simplified manner and other forms are illustrated in an enlarged manner in relation to other elements for better visualization.

Identical reference numerals are used for elements of the invention, which are identical or have an identical effect. Furthermore, only reference numerals, which are required for the description of the respective figure, are illustrated in the individual figures for the sake of clarity. The illustrated embodiments only represent examples for how the device according to the invention or the method according to the invention could be designed, and do not represent a conclusive limitation.

FIG. 1 shows a sectional illustration of spiral jet mill (1), having a grinding material feeding (2), through which the grinding material (10) is guided into the process chamber (3). The metering, thus the feeding of the grinding material (10), takes place via a metering unit (not illustrated), for example a rotary vane or a pumping device.

Grinding nozzles (4), which are positioned at a suitable distance from one another, protrude into the process chamber (3). This suitable distance varies, depending on the number of the grinding nozzles (4), and should be selected in such a way that the grinding nozzles (4) are distributed evenly on the circular path, which the housing (5) describes, which encloses the process chamber (3). In the example of FIG. 1, the grinding nozzles (4) are thus each arranged to be offset by 90°, and the respective longitudinal axis (41) thereof draw an angle alpha ($\alpha$), which is to lie in the range of between 10° and 60°, with a tangent (13) applied in the area of the respective grinding nozzle fastening in the housing (5).

With regard to the application, the grinding nozzles (4) can also be arranged irregularly on the housing (5)

The grinding nozzles (4) supply the grinding fluid (6) to the process chamber (3). This grinding fluid (6) serves the purpose of using and of comminuting the output grinding material (10). Depending on the application and fed grinding material (10), the parameters, such as, for example, pressure, quantity, temperature and spray angle, need to be adapted for the grinding fluid (6). For example gases, in particular protective gases, such as argon and helium and nitrogen, are possible as grinding fluid (6).

The fine material outlet (7), which guides particles out of the process chamber (3) through the lid or the bottom of the housing (5), is located in the center of the process chamber (3). The particles, which have obtained the necessary fineness by means of the grinding in the process chamber (3), thus the ground portions of the grinding material (11), are discharged through the fine material outlet (7). So that only particles comprising the necessary fineness can leave the process chamber (3), a separator wheel (8) is positioned around the fine material outlet (7). The separator wheel (8) rotates and is operated at a variable speed. The necessary fineness for the ground portions of the grinding material (11) can thus be set. If a particle, which is too large, wants to pass through the rotating separator wheel (8), it is centrifuged back into the process chamber (3) by means of the separator wheel (8) and is used again. If the particle is ground sufficiently fine, thus if it has a sufficiently fine particle or grain size, respectively, it can leave the process chamber (3) through the fine material outlet (7) with the fluid jet of the ground portions of the grinding material (11).

The portions of the grinding material (12), which are hard to grind or which cannot be ground, thus remain in the process chamber (3) and accumulate there in the course of the grinding process. To discharge these particles from the process chamber (3), the grinding material feeding (2) is closed with respect to the process chamber (3). The discharge nozzle (9) opens at the same time or at a defined offset in time. During the grinding process, said discharge nozzle is closed with respect to the process chamber (3) by means of a closure element (14), for example a flap or a gate. This closure element (14) can be positioned arbitrarily in the discharge nozzle (9), the closure element (14) can, for example, abut flush against the outer sleeve of the housing (5) or can be mounted inside the housing (5) and can be flush with the process chamber (3). Due to the positive pressure or negative pressure of between −500 mbar(g) and +600 mbar(g) prevailing in the process chamber (3), all particles, which are located in the process chamber (3), are now flushed out of the process chamber (3) via the discharge nozzle (9).

After a time period of, for example, 1 to 60 seconds, or a notification from a sensor, which monitors the fill level in the process chamber (3) and thus verifies whether all portions of the grinding material (12), which are hard to grind or which cannot be ground, were discharged from the process chamber, the discharge nozzle (9) is closed again by means of the closure element (14). The grinding material feeding (2) is opened or started again, respectively, subsequently and the grinding process is continued.

It can optionally also be provided to close the grinding material feeding (2) with respect to the process chamber (3) by means of a further closure element (15), analogously to the closure element (14) in the discharge nozzle (9).

The invention claimed is:

1. A method for comminuting a material mixture of components with different grindability, the material mixture containing grindable parts and hard to grind parts, the method comprising:

using a spiral jet mill that has a process chamber, a fine material outlet, and at least one discharge nozzle, feeding the material mixture into the process chamber, grinding the material mixture within the process chamber such that the grindable parts are ground into a fine material;

discharging the fine material from the process chamber via the fine material outlet, opening the discharge nozzle upon detecting an accumulation of the hard to grind parts within the process chamber, interrupting the feeding of the material mixture into the process chamber upon detecting the accumulation of the hard to grind parts within the process chamber, discharging the hard to grind parts from the process chamber via the opened discharge nozzle by means of a fluid, wherein the opening of the discharge nozzle and the interruption of the feeding are synchronized with each other.

2. The method according to claim 1, wherein the fluid for discharging the hard to grind parts is a grinding fluid which has been introduced into the process chamber for grinding the material mixture.

3. The method according to claim 2, wherein the spiral jet mill includes a grinding material feed inlet for feeding the material mixture into the process chamber, the method further comprising maintaining the discharge nozzle closed and the grinding material feed inlet closed during the grinding process.

4. The method according to claim 1, further comprising maintaining the discharge nozzle closed during the grinding process.

5. The method according to claim 1, wherein the discharge nozzle is opened automatically upon detecting the accumulation of the hard to grind parts within the process chamber.

6. The method according to claim 5, wherein the step of opening the discharge nozzle is performed for a duration between 1 and 10 seconds.

7. The method according to claim 1, wherein the feeding of the material mixture into the process chamber is interrupted automatically upon detecting the accumulation of the hard to grind parts within the process chamber.

8. The method according to claim 7, wherein the feeding of the material mixture is interrupted for a duration between 1 and 10 seconds.

9. The method according to claim 1, further comprising monitoring at least one operating parameter of the spiral jet mill during the grinding process to detect the accumulation of the hard to grind parts within the process chamber.

10. The method according to claim 9, wherein the feeding of the material mixture into the process chamber is interrupted when the at least one operating parameter is outside a defined value range.

11. The method according to claim 9, wherein the discharge nozzle is opened when the at least one operating parameter is outside a defined value range.

12. The method according to claim 9, wherein the at least one parameter comprises a fill level of the spiral jet mill, a quantity of the material mixture being fed into the process chamber, a speed of the material mixture being fed into the process chamber, a pressure of the fluid, a speed of the fluid, a quantity of the fluid, a speed of a separator wheel, a power consumption of a motor driving the separator wheel, and/or a grinding material throughput.

13. The method according to claim 1, wherein the spiral jet mill includes a grinding material feed inlet for feeding the material mixture into the process chamber, the method further comprising maintaining the grinding material feed inlet closed during the grinding process.

* * * * *